US010041204B2

(12) United States Patent
Kim et al.

(10) Patent No.: US 10,041,204 B2
(45) Date of Patent: Aug. 7, 2018

(54) CLOTHES TREATING APPARATUS

(71) Applicant: LG ELECTRONICS INC., Seoul (KR)

(72) Inventors: Youngsuk Kim, Seoul (KR); Sangwook Hong, Seoul (KR); Hyojun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 321 days.

(21) Appl. No.: 14/884,077

(22) Filed: Oct. 15, 2015

(65) Prior Publication Data

US 2016/0115642 A1 Apr. 28, 2016

(30) Foreign Application Priority Data

Oct. 28, 2014 (KR) ..... 10-2014-0147565

(51) Int. Cl.
*F26B 5/06* (2006.01)
*D06F 58/24* (2006.01)
*D06F 58/20* (2006.01)

(52) U.S. Cl.
CPC ..... *D06F 58/24* (2013.01); *D06F 58/206* (2013.01)

(58) Field of Classification Search
CPC ..... D06F 58/24
(Continued)

(56) References Cited

U.S. PATENT DOCUMENTS 4,513,585 A * 4/1985 Maisonneuve ..... F24H 4/04 62/238.6
5,042,171 A * 8/1991 Obata ..... D06F 58/24 34/604

(Continued)

FOREIGN PATENT DOCUMENTS

CN 101310067 11/2008
CN 102292489 12/2011

(Continued)

OTHER PUBLICATIONS

Chinese Office Action dated Apr. 28, 2017 Issued an Application No. 201510683520.1 (with English Translation).

(Continued)

*Primary Examiner* — John McCormack
(74) *Attorney, Agent, or Firm* — Ked & Associates, LLP

(57) ABSTRACT

Provided is a clothes treating apparatus. The clothes treating apparatus may include a clothes receiving device providing a space for receiving clothes therein, a circulation passage provided in the clothes receiving device and configured to provide a flow path for air circulation through the clothes receiving device, and a heat-exchanging device provided in the circulation passage and configured to dehumidify air introduced into the circulation passage. A blower may be provided in the circulation passage and configured to circulate air within the clothes receiving device. A condensed water discharge device may be provided at a lower surface of the circulation passage and configured to discharge condensed water generated by the heat-exchanging device. The condensed water discharge device may include a backflow-preventing member that prevents backflow of the condensed water from the condensed water discharge device to the circulation passage.

7 Claims, 5 Drawing Sheets

(58) Field of Classification Search
USPC ..... 34/292, 293, 467, 468, 469
See application file for complete search history.

(56) References Cited

U.S. PATENT DOCUMENTS

| | | | | |
|---|---|---|---|---|
| 2006/0137214 | A1* | 6/2006 | Achenbach | H05K 5/0213 34/468 |
| 2009/0218091 | A1* | 9/2009 | Dotson | E21B 41/0085 166/105.5 |
| 2011/0114135 | A1* | 5/2011 | Baurmann | D06F 58/20 134/26 |
| 2011/0289695 | A1* | 12/2011 | Colin | D06F 33/02 8/137 |
| 2016/0115643 | A1* | 4/2016 | Bison | D06F 58/24 34/468 |

FOREIGN PATENT DOCUMENTS

| | | | |
|---|---|---|---|
| CN | 202247384 | | 5/2012 |
| DE | 4238546 | A1 | 5/1994 |
| DE | 4300694 | A1 | 7/1994 |
| EP | 1548173 | A1 | 6/2005 |
| EP | 1961852 | A1 | 8/2008 |
| EP | 2436818 | A1 | 4/2012 |
| JP | 2007-330571 | A | 12/2007 |
| JP | 2008-253395 | A | 10/2008 |
| WO | WO 2010/095832 | A1 | 8/2010 |

OTHER PUBLICATIONS

European Search Report dated Feb. 9, 2016 issued in Application No. 15190463.8.

* cited by examiner

CLOTHES TREATING APPARATUS

CROSS-REFERENCE TO RELATED APPLICATION(S)

Pursuant to 35 U.S.C. § 119(a), this application claims the benefit of earlier filing date and right of priority to Korean Application No. 10-2014-0147565, filed on Oct. 28, 2014, the contents of which is incorporated by reference herein in its entirety.

BACKGROUND

1. Field

This specification relates to a clothes treating apparatus.

2. Background

A clothes treating apparatus (a laundry machine or a laundry treating apparatus) is a concept including an apparatus for washing or drying clothes, and an apparatus for simultaneously washing and drying clothes.

Clothes treating apparatuses which can dry clothes are configured to supply air of high temperature (hot air) to the clothes and may be classified into an exhaust type and a circulation type (condensing type) on the basis of an air flowing method.

The circulation type clothes treating apparatus is configured to circulate air of a clothes receiving unit storing clothes, in a manner of removing moisture (dehumidifying) from the air discharged from the clothes treating apparatus, heating the dehumidified air, and supplying the heated air back into the clothes receiving unit.

The exhaust type clothes treating apparatus is configured to supply heated air to a clothes receiving unit, in a manner of exhausting air discharged from the clothes receiving unit to outside of the clothes treating apparatus without circulation.

Meanwhile, a discharge passage provided in the related art clothes treating apparatus has a problem that condensed water generated in an evaporator may flow back into a heat exchanger due to negative pressure between the evaporator and a condenser, which causes odor and other problems due to the backflow from the discharge passage. The clothes treating apparatus of the present disclosure addresses these and other disadvantages.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Description will now be given in detail of the preferred embodiments according to the present disclosure, with reference to the accompanying drawings. Meanwhile, a configuration or control method to be described hereinafter is merely illustrative and will not limit the rights of the present disclosure. For the sake of brief description with reference to the drawings, the same or equivalent components may be provided with the same or similar reference numbers, and description thereof will not be repeated.

Figure 1:
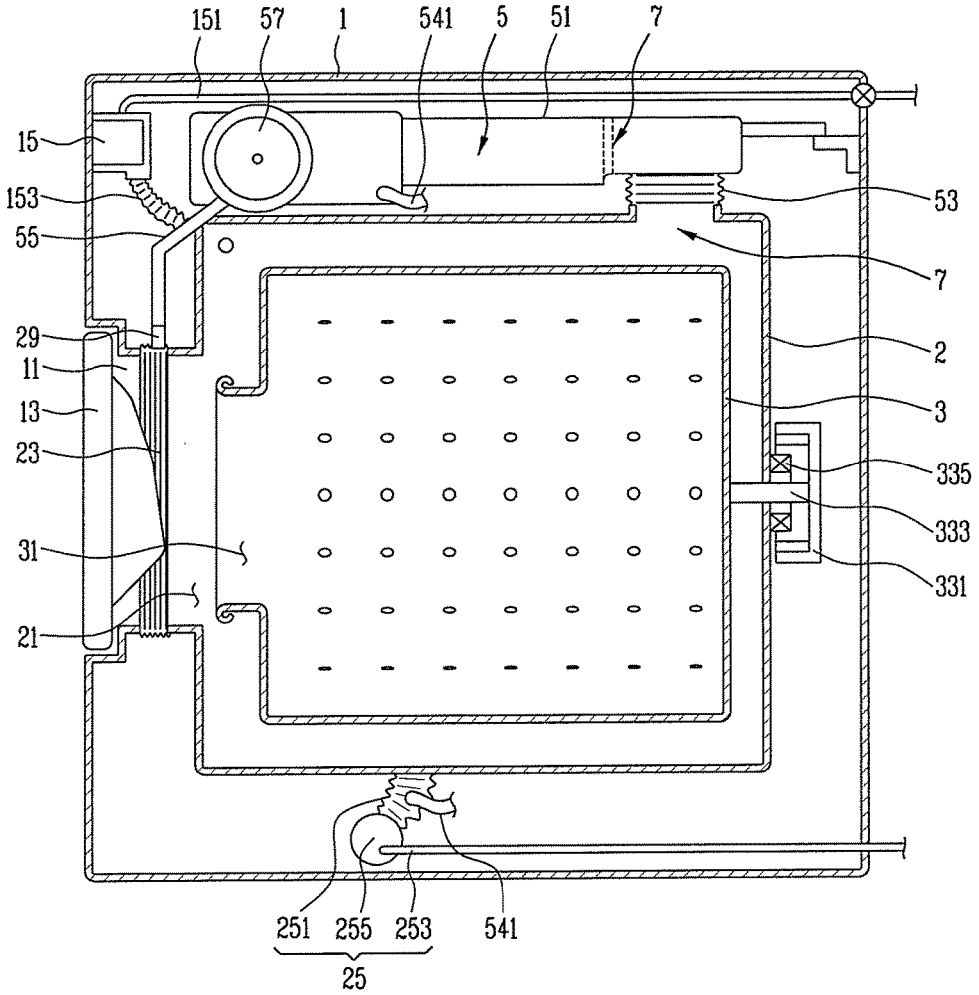
FIGS. 1 and 2 are views illustrating one embodiment of a clothes treating apparatus in accordance with the present disclosure.

FIG. 1 illustrates one embodiment of a clothes treating apparatus in accordance with the present disclosure. As illustrated in FIG. 1, a clothes treating apparatus 100 according to the present disclosure includes a cabinet 1 that defines an outer appearance of the apparatus, a clothes receiving device 2 and 3 provided in the cabinet 1 to receive clothes therein, and a hot air supply device 5 supplying hot air into the clothes receiving device 2 and 3.

The cabinet 1 includes an introduction opening 11 through which clothes is introduced therein, and a door 13 rotatably coupled to the cabinet 1 to open and close the introduction opening 11.

When the clothes treating apparatus 100 according to the present disclosure is merely configured as a drying machine which has a clothes drying function, the clothes receiving device 2 and 3 may include only a drum 3 rotatably disposed in the cabinet 1.

Also, when the clothes treating apparatus 100 is configured as an apparatus which has both functions of washing and drying clothes, the clothes treating apparatus 2 and 3 may include a tub 2 disposed in the cabinet 1 to store wash water therein, and a drum 3 rotatably disposed in the cabinet 2 to store the clothes therein.

The tub 2 may have a cylindrical shape with a hollow inner space and be fixed in the cabinet 1. The tub 2 includes a tub introduction opening 21 formed at a front surface of the tub 2 facing the introduction opening 11, such that the clothes or laundry can be introduced and removed through the tub introduction opening 21.

A gasket 23 may be provided between the tub introduction opening 11 and the introduction opening 11. The gasket 23 may prevent wash water stored in the tub 2 from being leaked out of the tub 2 and also may prevent vibration generated in the tub 2 during rotation of the drum 3 from being transferred to the cabinet 1. Therefore, the gasket 23 may be made of a vibration-insulating material, such as rubber.

The tub 2 may be arranged in parallel to the ground, or to be inclined from the ground by a predetermined angle. However, when the tub 2 is inclined from the ground by the predetermined angle, the inclined angle of the tub 2 is preferably smaller than 90°.

An air exhaust portion 27 through which internal air of the tub 2 is exhausted may be provided on an upper portion of a circumferential surface of the tub 2, and a water drain portion 25 through which the wash water stored in the tub 2 is discharged may be provided below the tub 2.

The air exhaust portion 27 may be provided on the upper surface of the tub 2, preferably, spaced apart from a straight line A, which passes through a center of the tub 2, by a predetermined distance L1 in a circumferential direction of the tub 2. This facilitates the internal air of the tub 2 to be discharged out of the tub 2 through the air exhaust portion 27 during the rotation of the drum 3.

The water drain portion 25 may include a first drain pipe 251 through which a drain pump 255 is connected to the tub 2, and a second drain pipe 253 that guides the wash water introduced into the drain pump 255 to the outside of the cabinet 1.

The tub 2 stores wash water that is supplied through a water supply pipe 151 which connects the tub 2 to a water supply source. Here, when a detergent supply unit 15 for supplying detergent is provided at the cabinet 1, the water supply pipe 151 may be configured to supply wash water to the detergent supply unit 15 therethrough. In this instance, the wash water supplied to the detergent supply unit 15 may then be supplied into the tub 2 through a detergent supply pipe 153.

The drum 3 may have a cylindrical shape with a hollow inner space, and be rotatably disposed in the tub 2. The drum 3 is rotatable by a driving unit provided outside of the tub 2. In this instance, the driving unit may include a stator 335 fixed to a rear surface of the tub 2 to generate a magnetic field, a rotor 331 rotated by the magnetic field, and a rotation shaft 333 penetrating through the rear surface of the tub 2 to connect a rear surface of the drum 3 to the rotor 331.

In the meantime, the drum 3 may include a drum introduction opening 31 formed at a front surface thereof, so as to communicate with the introduction opening 11 and the tub introduction opening 21. A user may thus put clothes or laundry into the drum 3 and take the clothes stored in the drum 3 out of the cabinet 1 through the introduction opening 11.

Figure 2:
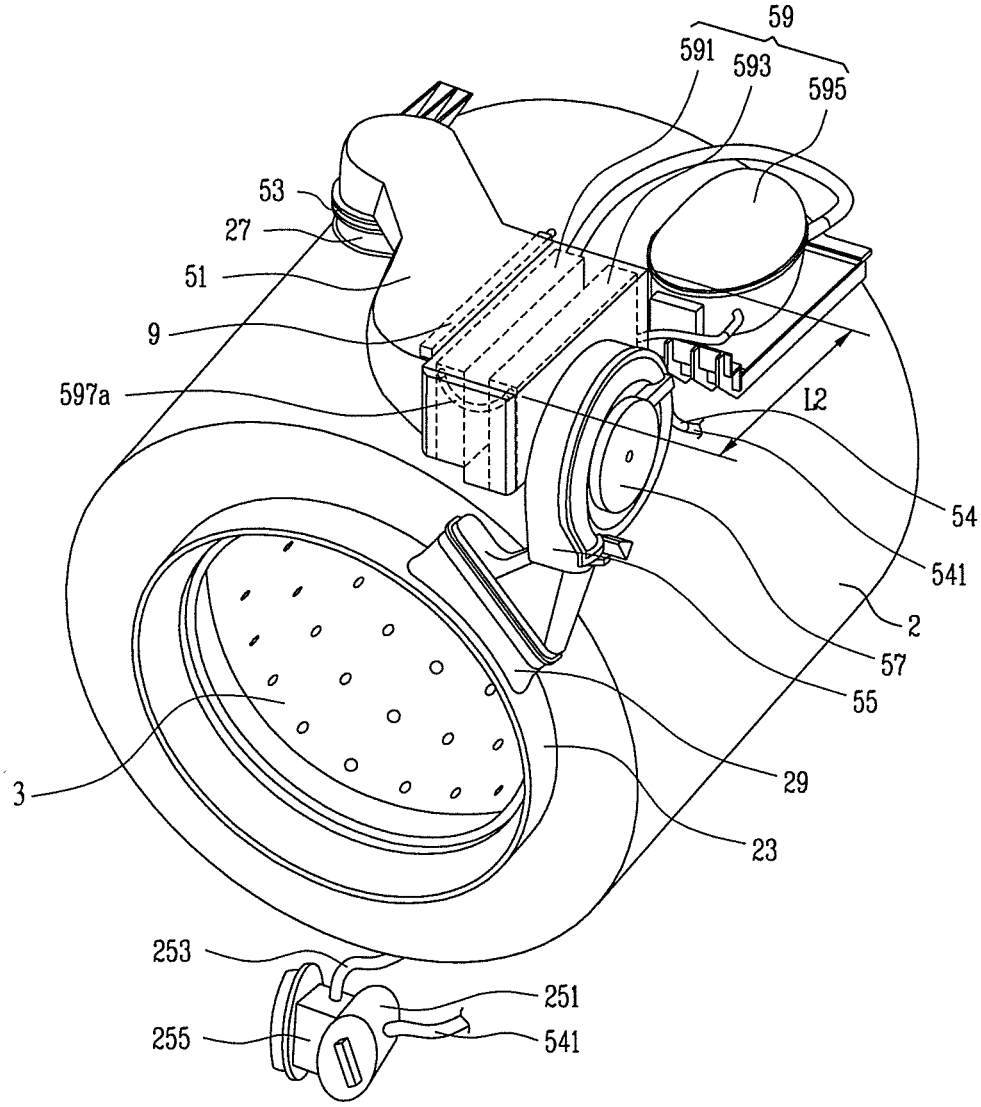

As illustrated in FIG. 2, the hot air supply device 5 may include a circulation passage 51, 53 and 55 to guide air discharged from the tub 2 toward a front side of the tub 2. A blower 57 may be provided in the circulation passage 51, 53 and 55 to circulate internal air of the circulation passage. Moreover, a heat-exchanging device 59 may be provided in the circulation passage 51, 53 and 55.

The circulation passage may include a first connection duct 53 connected to the upper portion of the circumferential surface of the tub 2, a duct 51 connected to the first connection duct 53 and provided with the heat-exchanging device 59 therein, and a second connection duct 55 to guide air discharged from the duct 51 toward the front side of the tub 2.

The first connection duct 53 may be a passage connected to the air exhaust portion 27 located at the upper portion of the circumferential surface of the tub 2, and preferably formed as a vibration-insulating member (rubber, etc.). This is to prevent the vibration transferred to the tub 2 during the rotation of the drum from being carried to the heat-exchanging device 59 located in the duct 51 through the first connection duct 53. To more efficiently prevent the vibration generated in the tub 2 from being transferred to the duct 51 and the heat-exchanging device 59, the first connection duct 53 may be formed in a shape of a bellows.

The second connection duct 55 may be connected to any area of the tub 2 if the area is allowed to guide the air discharged through the duct 51 toward the front side of the tub 2. FIG. 2 illustrates one example in which the second connection duct 55 allows air to be supplied into the tub 2 through the gasket 23. In this instance, the gasket 23 may further be provided with a supply portion 29 in communication with the second connection duct 55.

The blower 57 may be provided at the second connection duct 55. The blower 57 may include an impeller (not illustrated) located in the second connection duct 55, and an impeller motor (not illustrated) to rotate the impeller.

Figure 3:
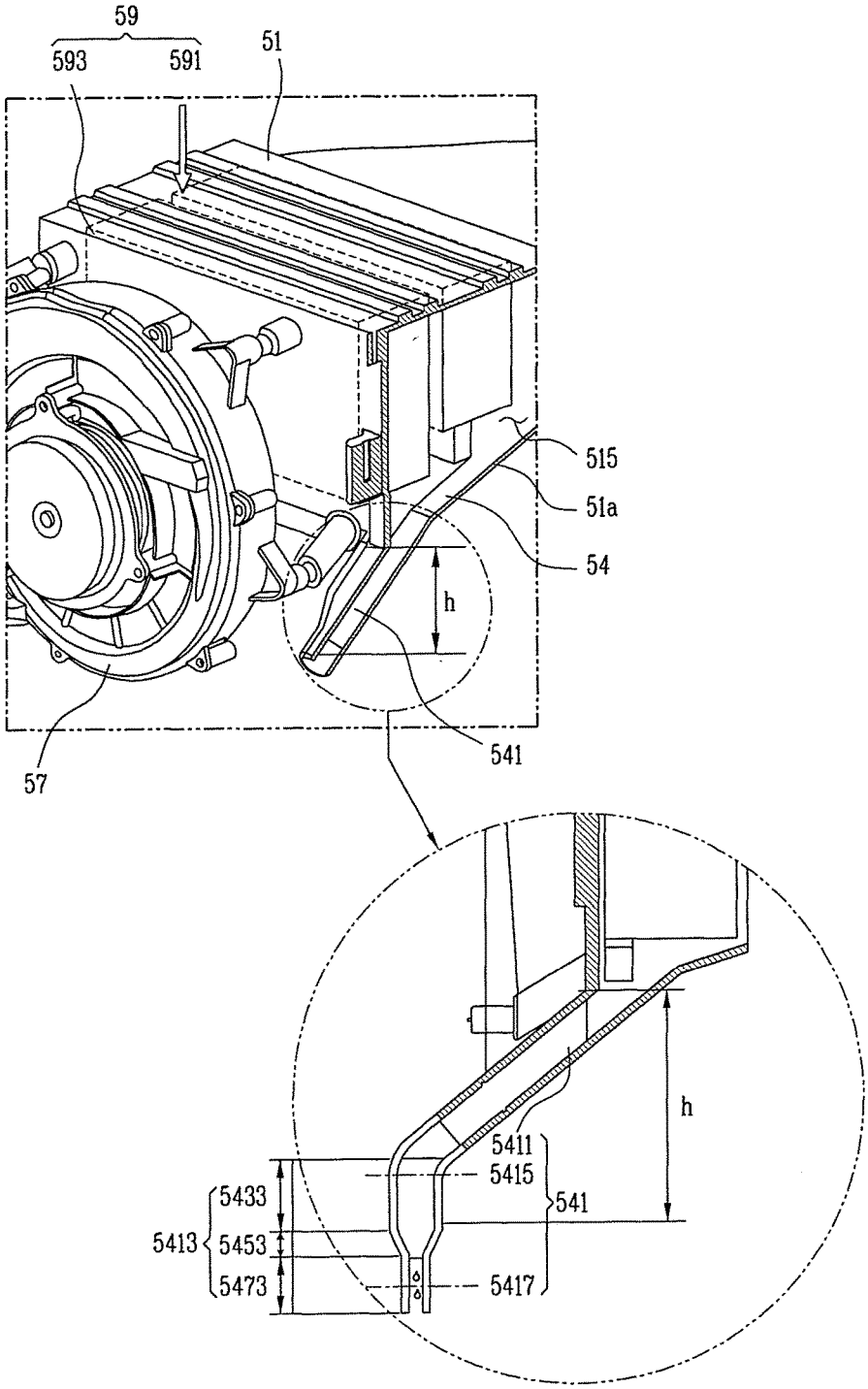
FIG. 3 is a view illustrating one embodiment of a condensed water discharge device in accordance with the present disclosure.

As illustrated in FIG. 3, the duct 51 according to the present disclosure includes a base 51*a* forming a lower portion thereof, a first mounting portion 515 formed at the base 51*a* and having the heat-exchanging device 59 mounted thereon, and a discharge duct through which condensed water generated in the first mounting portion 515 is discharged.

The heat-exchanging device 59 according to the present disclosure may be configured as a heat pump. Here, a first heat exchanger 591 (i.e., an evaporator) and a second heat exchanger 593 (i.e., a condenser) provided in the heat-exchanging device 59 may be fixed to the first mounting portion 515. A compressor 595 may be configured to compress a refrigerant discharged from the evaporator 591 and supply the compressed refrigerant to the condenser 593. The refrigerant supplied to the condenser 593 may be supplied back into the evaporator 591 via an expansion apparatus.

In the evaporator 591, the refrigerant is evaporated by absorbing heat from air introduced into the duct 51. Therefore, the evaporator 391 serves to remove moisture (dehumidify) contained in air by cooling the air.

The condenser 593 condenses the refrigerant. Since heat generated during the process of condensing the refrigerant is transferred to air passing through the condenser, the condenser 593 serves to heat the air passed through the evaporator 591.

Here, the condensed water is generated in the evaporator 591 while the refrigerant removes moisture (dehumidifies) from air introduced into the duct 51. Hence, a structure for discharging the condensed water is required.

The condensed water generated in the evaporator 591 is discharged out of the clothes treating apparatus along the discharge duct. Here, pressure gradients are generated to suck air through the air exhaust opening 27 provided at the tub 2 and discharged to the supply portion 29 provided at the tub 2.

During this, negative pressure is generated between the evaporator 591 and the condenser 593. As a result, the condensed water generated in the evaporator 591 may not be discharged out along the discharge duct, but may flow back into the duct 51 or allow gases from the drain to flow back into the duct 51 causing odors.

To prevent this problem, the condensed water discharge device 54 according to the present disclosure is provided with a back-flow preventing member. In one embodiment, the back-flow preventing member may be a discharge pipe 541.

The discharge pipe 541 may include an inclined portion 5411 (upper section) protruding from a lower surface of the duct 51 in an inclined manner, and a vertical portion 5413 (lower section) that extends from an end of the inclined portion 5411. The upper section may be inclined to extend downward at a prescribed angle. The vertical portion 5413 may extend vertically or perpendicular to the bottom surface of the condensed water discharge unit 54. Moreover, it should be appreciated that the vertical portion 5413 may be substantially vertical or sufficiently angled such that condensed water may easily flow down the discharge pipe 541.

The vertical portion 5413 may include a first portion 5433 having a first cross-section 5415, and a second portion 5473 having a second cross-section 5417. The first cross-section 5415 may be greater than the second cross-section 5417, and the first cross-section 5415 may be located above the second cross-section 5417. The vertical portion 5413 may be formed linear such that the first portion 5433 and second portion 5473 are also linear and may extend perpendicular to the condensed water discharge unit 54.

The vertical portion 5413 may include a bottleneck portion 5453 that is formed between the first portion 5433 and the second portion 5473 in a manner in which its cross-section gets narrower from the first portion to the second portion. That is, the width of the bottleneck portion 5453 may gradually decrease downward. Moreover, a width of the first portion 5433 and a width of the second portion 5473 in the vertical portion 5413 (lower section) of the discharge pipe may be configured such that condensed water is accumulated above the lower portion to prevent backflow of gas and condensed water into the circulation passage. The bottleneck portion 5453 may thus function as a reservoir in which the condensed water is stored or accumulated.

The shape of the vertical portion 5413 makes the condensed water seem to be stuck (stored or collected) in the reservoir, which may prevent the condensed water and odor from flowing back into the duct 51 through the discharge duct.

The bottleneck portion 5453 becomes gradually narrower from the first cross-section 5415 toward the second cross-section 5417. Here, a height h from the bottleneck portion 5453 to a point where the inclined portion 5411 is brought into contact with the duct 51 is preferably at least 120 mm or more.

Negative pressure is generated in the duct 51 due to rotation of the blower 57. Accordingly, the condensed water generated during drying is kept stored in the discharge duct.

Therefore, by virtue of the structure that the height from the bottleneck portion 5453 to the contact point between the inclined portion 5411 and the duct 51 is preferably at least 120 mm or more, the condensed water which is kept stored in the discharge duct can be prevented from flowing back into the duct 51.

However, the present disclosure may not be limited to the numeral value of 120 mm, and the numeral value may vary depending on a rotating speed of the blower 57, a size of the duct 51 and a size of the heat-exchanging device 59.

That is, when about 40 to 50 cc/min of condensed water is generated per minute, it may be preferable in a typical heat pump cycle that the height from the bottleneck portion 5453 to the contact point between the inclined portion 5411 and the duct 51 is at least 120 mm or more.

Figure 4A:
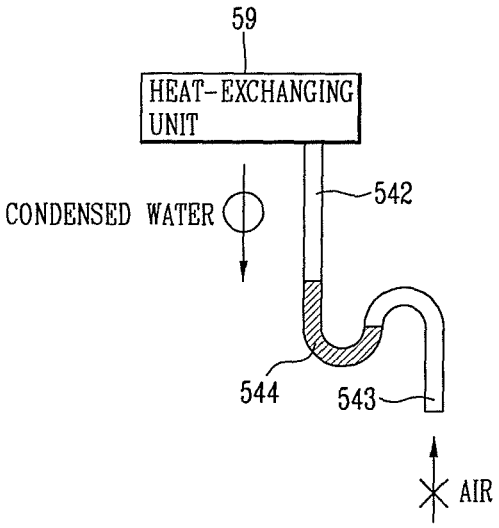
FIGS. 4A to 4C are views illustrating other embodiments of a condensed water discharge device in accordance with the present disclosure.

FIG. 4A illustrates a condensed water discharge device according to one embodiment of the present disclosure. A U-shaped pipe 544 may be included in a discharge passage 541 as a backflow-preventing member. The discharge passage 541 may include a first discharge pipe 542 having one end directly communicating with the first mounting portion 515 at which the heat-exchanging device 59 is mounted, and another end communicating with the U-shaped pipe 544. A second discharge pipe 543 may be provided having one end communicating with the U-shaped pipe 544 and another end communicating with an outside.

The U-shaped pipe 544 may have one end communicating with the first discharge pipe 542 and another end communicating with the second discharge pipe 543 and formed in a U-like shape. The U-shaped pipe 544 may allow the first discharge pipe 542 to be in communication with the second discharge pipe 543 and may be formed in the shape like an alphabet "U."

Condensed water that flows down along the first discharge pipe 542 may be collected in the U-shaped pipe 544. Also, the another end of the second discharge pipe 543 is configured to communicate with external air such that air pressure and a weight of the condensed water are balanced, thereby preventing backflow of the condensed water and odors from the drain.

Figure 4B:
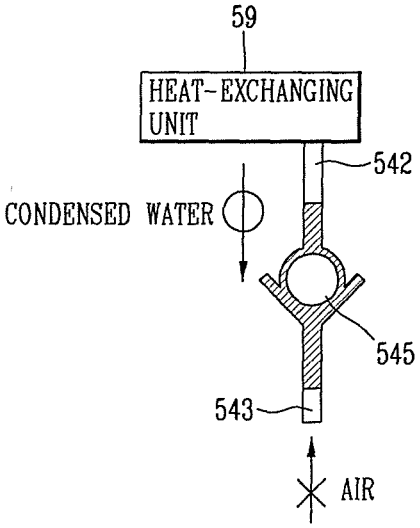

FIG. 4B illustrates a condensed water discharge device according to one embodiment of the present disclosure. Here, a check valve 545 may be provided at the condensed water discharge device 54 as a backflow-preventing member. The condensed water discharge device 54 may include a first discharge pipe 542 having one end communicating with a surface of the first mounting portion 515 at which the heat-exchanging device 59 is mounted. Another end of the first discharge pipe 542 may be in communication with the check valve 545. A second discharge pipe 543 may be provided having one end communicating with the check valve 545 and another end communicating with an outside. The check valve 545 may have one end communicating with the first discharge pipe 542 and another end communicating with the second discharge pipe 543 and configured to allow the condensed water to be transferred from the first discharge pipe 542 only to the second discharge pipe 543.

The check valve 545 is a device which allows a fluid or gas flowing therein to be transferred only in one direction. When the check valve 545 is provided between the first discharge pipe 542 and the second discharge pipe 543, the condensed water generated in the heat-exchanging device 59 is forced to flow from the first discharge pipe 542 only to the second discharge pipe 543. This may prevent the condensed water from flowing from the second discharge pipe 543 back to the first discharge pipe 542 or allow gases from the drain to flow backward causing odors.

Figure 4C:
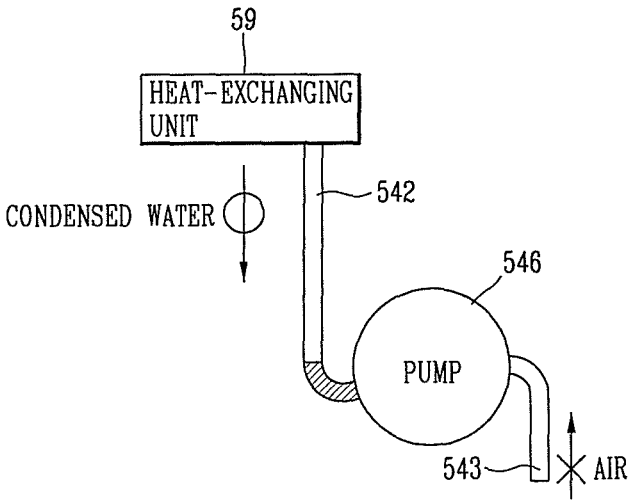

FIG. 4C illustrates a condensed water discharge device 54 according to another example. Here, a pump may be provided as a backflow-preventing member. The condensed water discharge device 54 may include a first discharge pipe 542 having one end communicating with the first mounting portion 515 at which the heat-exchanging device 59 is mounted and another end communicating with a pump 546. A second discharge pipe 543 may be provided having one end communicating with the pump 546 and another end communicating with an outside. A pump 546 may be provided having one end communicating with the first discharge pipe 542 and another end communicating with the second discharge pipe 543. The pump may be configured to pump the condensed water stored in the first discharge pipe 542 into the second discharge pipe 543.

The pump 546 is a type of a pump that is generally used in the clothes treating apparatus according to the present disclosure, and thus detailed description thereof will be omitted.

The pump 546 may be provided between the first discharge pipe 542 and the second discharge pipe 543 to communicate them with each other, so as to force the condensed water generated in the heat-exchanging device 59 to flow from the first discharge pipe 542 only to the second discharge pipe 543. Therefore, the condensed water or odors from the drain cannot flow back into the first discharge pipe 542 from the second discharge pipe 543.

As broadly described and embodied herein, one aspect of the detailed description is to provide a clothes treating apparatus capable of preventing condensed water generated in an evaporator and odors from a drain from flowing back into a heat exchanger.

To achieve these and other advantages and in accordance with the purpose of this specification, in one embodiment, a clothes treating apparatus may include a clothes receiving unit providing a space for receiving clothes therein, a circulation passage provided in the clothes receiving unit and providing a space for air to circulate, a heat-exchanging unit provided in the circulation passage and configured to dehumidify air introduced into the circulation passage, a blower provided in the circulation passage and configured to circulate air within the clothes receiving unit, and a condensed water discharge unit provided at one surface of the circulation passage and configured to discharge condensed water generated in the heat-exchanging unit, wherein the condensed water discharge unit has one end communicating with the one surface of the circulation passage and another end with a section getting narrow.

Also, the condensed water discharge unit may include an inclined portion communicating with one surface of the circulation passage and protruding from a lower surface of the circulation passage in an inclined manner, and a perpendicular portion having one end communicating with the inclined portion and another end protruding in a direction perpendicular to the lower surface of the circulation passage.

The perpendicular portion may include a first perpendicular portion with a first section, a second perpendicular portion having a second section narrower than the first section, and a bottleneck portion formed from the first perpendicular portion to the second perpendicular portion in a manner that a section thereof is getting narrow.

The bottleneck portion may have one end with the first section and another end with the second section getting narrow from the first section. A height from an upper surface of the bottleneck portion to a portion where the inclined portion is brought into contact with the circulation passage is 120 mm.

In one embodiment, a clothes treating apparatus may include a clothes receiving unit providing a space for receiving clothes therein, a circulation passage provided in the clothes receiving unit and providing a space for air to circulate, a heat-exchanging unit provided in the circulation passage and configured to dehumidify air introduced into the circulation passage, a blower provided in the circulation passage and configured to generate negative pressure within the heat-exchanging unit so as to transfer the dehumidified air in the heat-exchanging unit, and a condensed water discharge unit provided at one surface of the circulation passage and configured to discharge condensed water generated while in the heat-exchanging unit dehumidifies air, wherein the condensed water discharge unit includes a backflow-preventing member.

The backflow-preventing member may be a U-shaped pipe. The condensed water discharge unit may include a first discharge pipe having one end communicating with the circulation passage and another end communicating with the U-shaped pipe, a second discharge pipe having one end communicating with the U-shaped pipe, and the U-shaped pipe having one end communicating with the first discharge pipe and another end communicating with the second discharge pipe so as to prevent the backflow of the condensed water.

The backflow preventing member may be a check valve. The condensed water discharge unit may include a first discharge pipe having one end communicating with the circulation passage and another end communicating with the check valve, a second discharge pipe having one end communicating with the check valve, and the check valve having one end communicating with the first discharge pipe and another end communicating with the second discharge pipe, so as to prevent the backflow of the condensed water.

The backflow-preventing member may be a pump. The condensed water discharge unit may include a first discharge pipe having one end communicating with the circulation passage and another end communicating with the pump, a second discharge pipe having one end communicating with the pump, and the pump having one end communicating with the first discharge pipe and another end communicating with the second discharge pipe, so as to prevent the backflow of the condensed water.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus comprising:

a clothes receiving device providing a space for receiving clothes therein;

a circulation passage provided in the clothes receiving device and configured to provide a flow path for air circulation through the clothes receiving device;

a heat-exchanging device provided in the circulation passage and configured to dehumidify air introduced into the circulation passage;

a blower provided in the circulation passage and configured to circulate air within the clothes receiving device; and a condensed water discharge device provided at a lower surface of the circulation passage and configured to discharge condensed water generated by the heat-exchanging device, wherein the condensed water discharge device includes a backflow-preventing member that prevents backflow of the condensed water from the condensed water discharge device to the circulation passage, wherein the clothes receiving device includes a drum, and the heat-exchanging device is provided over the drum inside a cabinet of the clothes treating apparatus, and wherein the backflow-preventing member is provided over the drum between the heat exchanging device and the drum.

2. A clothes treating apparatus comprising:

a clothes receiving device that includes a drum;

a heat-exchanging device provided over the drum;

a circulation passage to provide a flow path for air circulation between the drum and the heat-exchanging device;

a blower provided in the circulation passage and configured to generate airflow within the circulation passage; and a condensed water discharge device coupled to the circulation passage, wherein the heat-exchanging device is positioned inside the circulation passage and configured to dehumidify air, and the circulation passage includes a lower surface positioned under the heat-exchanging device to collect condensed water from the heat-exchanging device, wherein the condensed water discharge device is connected to the lower surface of the circulation passage to discharge the collected condensed water, and wherein the condensed water discharge device includes a backflow-preventing member that prevents backflow of the condensed water from the condensed water discharge device to the circulation passage, wherein the backflow-preventing member is a discharge pipe having an upper section connected to the lower surface of the circulation passage and a lower section that extends downward from the upper section, wherein the upper section is inclined at a prescribed angle to extend downward from the circulation passage and the lower section is angled relative to the upper section to extend down toward a bottom of the clothes treating apparatus.

3. The apparatus of claim 2, wherein the lower section extends linearly downward from the upper section and includes a first portion having a first width, a second portion having a second width narrower than the first width of the first portion, and a bottleneck portion that extends downward from the first portion to the second portion, a width of the bottleneck portion decreasing gradually from the first portion to the second portion such that condensed water accumulates above the bottleneck portion inside the discharge pipe.

4. A clothes treating apparatus comprising:

a clothes receiving device providing a space for receiving clothes therein;

a circulation passage provided in the clothes receiving device and configured to provide a flow path for air circulation through the clothes receiving device;

a heat-exchanging device provided in the circulation passage and configured to dehumidify air introduced into the circulation passage;

a blower provided in the circulation passage and configured to circulate air within the clothes receiving device; and a condensed water discharge device provided at a lower surface of the circulation passage and configured to discharge condensed water generated by the heat-exchanging device, wherein the condensed water discharge device includes a backflow-preventing member that prevents backflow of the condensed water from the condensed water discharge device to the circulation passage, wherein the backflow-preventing member is a discharge pipe having an upper section connected to the lower surface of the circulation passage and a lower section that extends downward from the upper section, wherein the upper section is inclined at a prescribed angle to extend downward from the circulation passage and the lower section of the discharge pipe is angled relative to the upper section to extend down toward a bottom of the clothes treating apparatus, wherein the lower section of the discharge pipe includes a first portion having a first width, a second portion having a second width narrower than the first width of the first portion, and a bottleneck portion that extends downward from the first portion to the second portion, wherein the first width of the first portion and the second width of the second portion in the lower section of the discharge pipe is configured such that condensed water is accumulated above the second portion to prevent backflow of gas and condensed water into the circulation passage.

5. The apparatus of claim 4, wherein the bottleneck portion has an upper end having the first width of the first portion and a lower end having the second width of the second portion, a width of the bottleneck portion decreasing gradually from the first portion to the second portion.

6. The apparatus of claim 4, wherein a distance between the bottleneck portion and the lower surface of the circulation passage is at least 120 mm.

7. The apparatus of claim 4, wherein the condensed water discharge device is positioned under the circulation passage, and the lower surface of the circulation passage is inclined to direct flow of condensed water to the condensed water discharge device.

* * * * *